US006658795B2

(12) United States Patent
Jung

(10) Patent No.: US 6,658,795 B2
(45) Date of Patent: Dec. 9, 2003

(54) VEHICULAR POWER WINDOW REGULATOR

(75) Inventor: Ok-Tae Jung, Seoul (KR)

(73) Assignee: Hyundai Motor Corporation, Seoul (KR)

( * ) Notice: Subject to any disclaimer, the term of this patent is extended or adjusted under 35 U.S.C. 154(b) by 0 days.

(21) Appl. No.: 10/085,235

(22) Filed: Feb. 26, 2002

(65) Prior Publication Data

US 2003/0014921 A1 Jan. 23, 2003

(30) Foreign Application Priority Data

Jul. 21, 2001 (KR) ..... 2001-44028

(51) Int. Cl.[7] ..... E05F 11/38
(52) U.S. Cl. ..... 49/375
(58) Field of Search ..... 49/374, 375, 348, 49/349, 350, 351, 213; 16/93 R, 90, 93 D, 95 R

(56) References Cited

U.S. PATENT DOCUMENTS

| | | | | |
|---|---|---|---|---|
| 3,604,151 A | | 9/1971 | Ventre | |
| 3,888,047 A | | 6/1975 | Chikaraishi | |
| 4,026,088 A | | 5/1977 | Akabane | |
| 4,694,610 A | | 9/1987 | Hornivius | |
| 4,706,412 A | * | 11/1987 | Kobrehel | 49/352 |
| 4,825,594 A | | 5/1989 | Escaravage | |
| 4,829,630 A | * | 5/1989 | Church et al. | 16/93 R |
| 4,935,986 A | * | 6/1990 | Church et al. | 16/93 R |
| 5,195,211 A | | 3/1993 | Krajenke | |
| 5,243,785 A | | 9/1993 | Nieboer et al. | |
| 5,392,563 A | | 2/1995 | Cardine | |
| 5,647,094 A | | 7/1997 | Mariel | |
| 5,771,534 A | | 6/1998 | Church | |
| 5,784,832 A | * | 7/1998 | Lee Van | 49/352 |
| 6,425,204 B1 | * | 7/2002 | Renner | 49/213 |

FOREIGN PATENT DOCUMENTS

| | | | | |
|---|---|---|---|---|
| JP | 6-137023 | * | 5/1994 | 49/348 |

* cited by examiner

*Primary Examiner*—Jerry Redman
(74) *Attorney, Agent, or Firm*—Pennie & Edmonds LLP

(57) ABSTRACT

A vehicular power window regulator wherein flexibility required when a door glass is vertically moved is appropriately provided to a connected area of a guide rail where a main arm and the door glass are connected to thereby prevent working forces such as compression and tension generated due to lack of flexibility at the connected area according to the prior art from being generated, and to avoid the main arm from being bent when the door glass moves along a curved route, and to prevent a sector gear from being applied with an excessive force for decrease of noise caused by gear meshing.

5 Claims, 4 Drawing Sheets

VEHICULAR POWER WINDOW REGULATOR

FIELD OF THE INVENTION

The present invention relates to a vehicular power window regulator, and more particularly to a vehicular power window regulator adapted to absorb compression and tension relative to curvilinear motion of window glass when the window glass is lifted.

BACKGROUND OF THE INVENTION

Generally, power window regulators are apparatus for automatically sliding up and down a vehicular door window glass according to vertical manipulation of a power window switch. A power window regulator according to the prior art, as illustrated in FIG. 1, is mounted with a guide rail 104 underneath a door glass 102. The guide rail 104 is rotatably mounted with a main arm 106 and a sub arm 108, which cross in X-arm shape. The main arm 106 is connected thereunder to a driving motor 112 by way of a sector gear 110, while the sub arm 108 is rotatably connected thereunder to one side of the door trim. The driving gear 112 is meshed with the sector gear 110 to rotate same within a predetermined range, while the sector gear 110 is connected to the main arm 106 to rotate same and to allow the door glass 102 to slide up and down.

As illustrated in FIGS. 2 and 3, a hinged connection structure between the guide rail 104 and the main arm 106 includes a slider 116 slidably arranged at the guide rail 104, a slider shaft 118 vertically protruded from the slider 116 and a hinge groove formed at the main arm 106 for the slider shaft 118 to be inserted thereinto.

In the conventional power window regulator thus described, when the motor 112 is driven, the sector gear 110 rotates the main arm 106, and by the rotation of the main arm 106, the slider 116 moves along the guide rail 104 to move the door glass 102 up and down. The main arm 106 is vertically operated on a linear route while the door glass 102 moves on a curvilinear route, because the door glass 102 is shaped with predetermined curvature. As a result, compression and tension are generated at the connection area between the guide rail 104 and the main arm 106. These forces arise from the paths followed by those two parts in lifting of the door glass 102 such that the main arm 106 is bent inwardly and outwardly, and the sector gear 110 and the driving motor are not properly meshed, resulting in generation of noise.

In order to overcome the afore-mentioned problems, the driving motor and sector gear are often reinforced, or the size of teeth at the gears is increased to prevent mismeshing, but these measures can hardly be a fundamental solution as only strength has been increased against the compression and tension generated by vertical motion of the door glass. There is another problem with the reinforced strength thus described in that weight and size of each part, including parts of the main arm, are increased, resulting in an increase in the manufacturing cost and the overall weight of the regulator.

SUMMARY OF THE INVENTION

The present invention provides a vehicular power window regulator adapted to allow compression and tension generated during vertical motion of a door glass to be compensated at a connection area between a main arm and a guide rail to prevent the main arm from being bent, and to reduce noise generated in a sector gear, whereby there is no need of increasing weight or size of each part for reinforced strength, leading to reduction in manufacturing cost and overall weight.

In accordance with a preferred embodiment of the present invention, there is provided a vehicular power window regulator, comprising a guide rail, a main arm, a driving motor and flex means. The guide rail is fixed to a lower end of the door glass. The main arm and a sub arm are connected for linear motion on the guide rail and mounted crosswise. The driving motor is connected to a sector gear mounted underneath the main arm to rotate the main arm. The flex means provides flexibility to a connection area between the main arm and the guide rail when the door glass vertically moves. The flex means includes a slider mounted on the guide rail, a slide shaft on the slider, and a grip. The grip has an inner circumferential surface placed over the slide shaft opposite the slider, and an external circumferential surface thereof inserted into the main arm.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Now, a preferred embodiment of the present invention will be described in detail with reference to the accompanying drawings.

Figure 1:
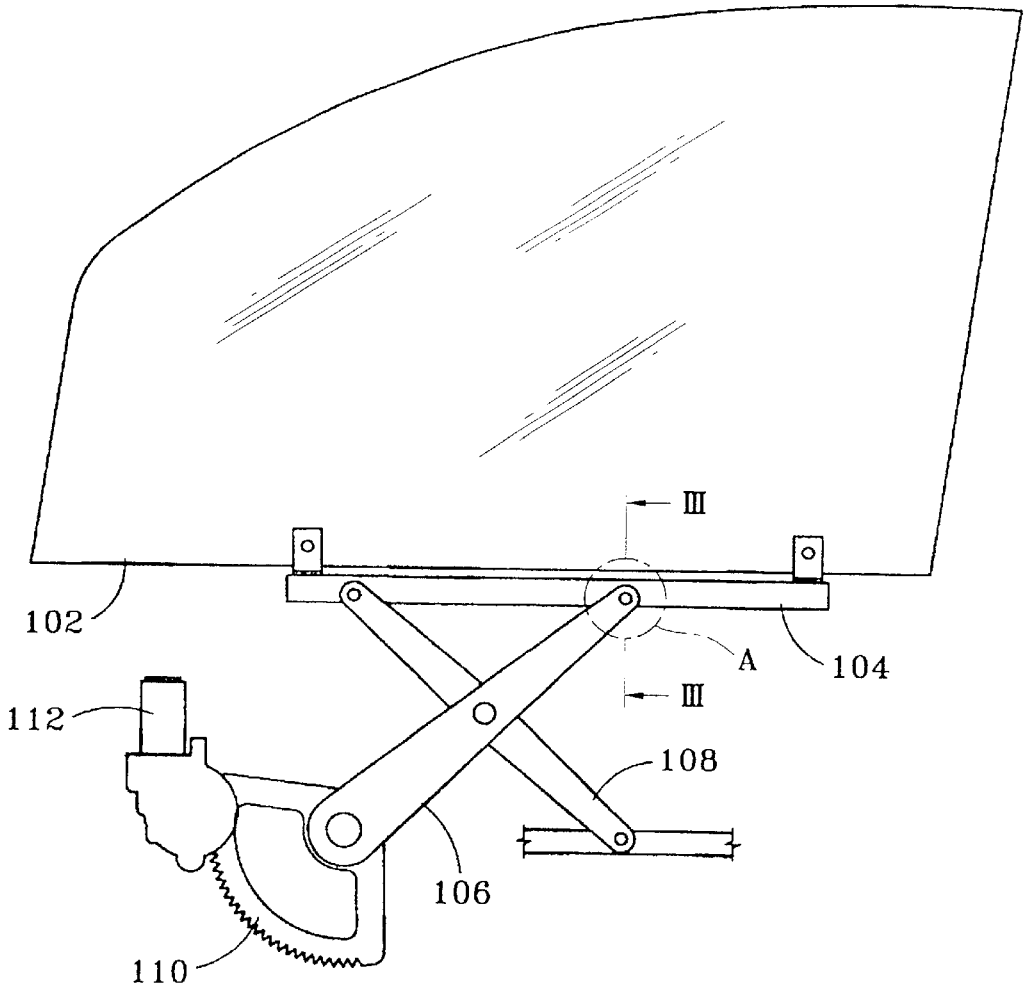
FIG.1 (Prior art)
FIG. 1 is a side view of a power window regulator according to the prior art.
Figure 2:
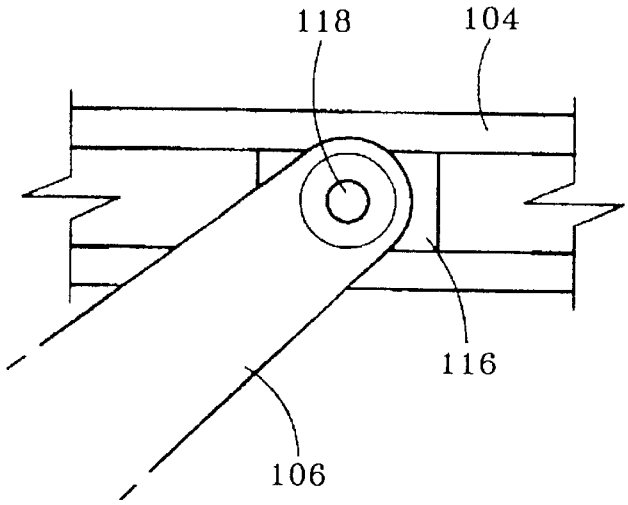
FIG.2 (Prior art)
FIG. 2 is an enlarged view of "A" part in FIG. 1.
Figure 3:
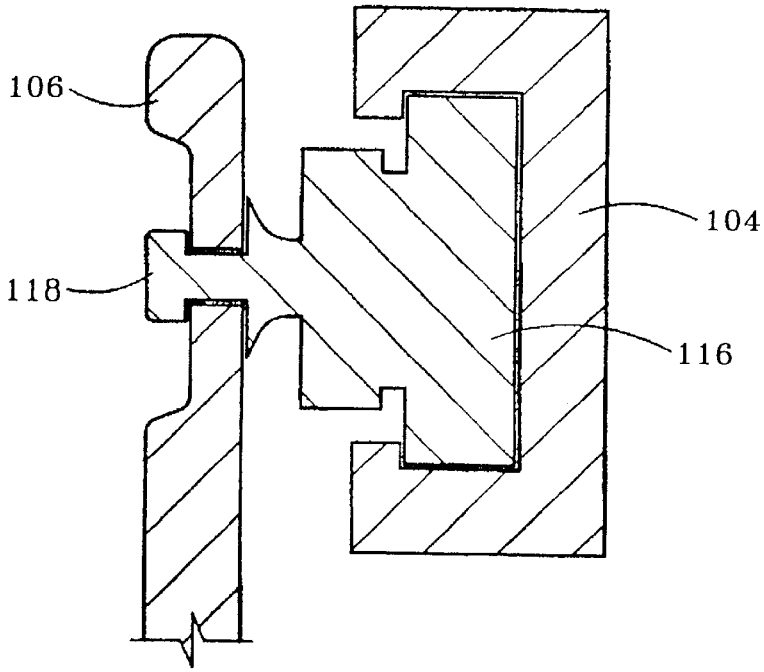
FIG.3 (Prior art)
FIG. 3 is a sectional view taken along line 111—111 of FIG. 1.
Figure 4:
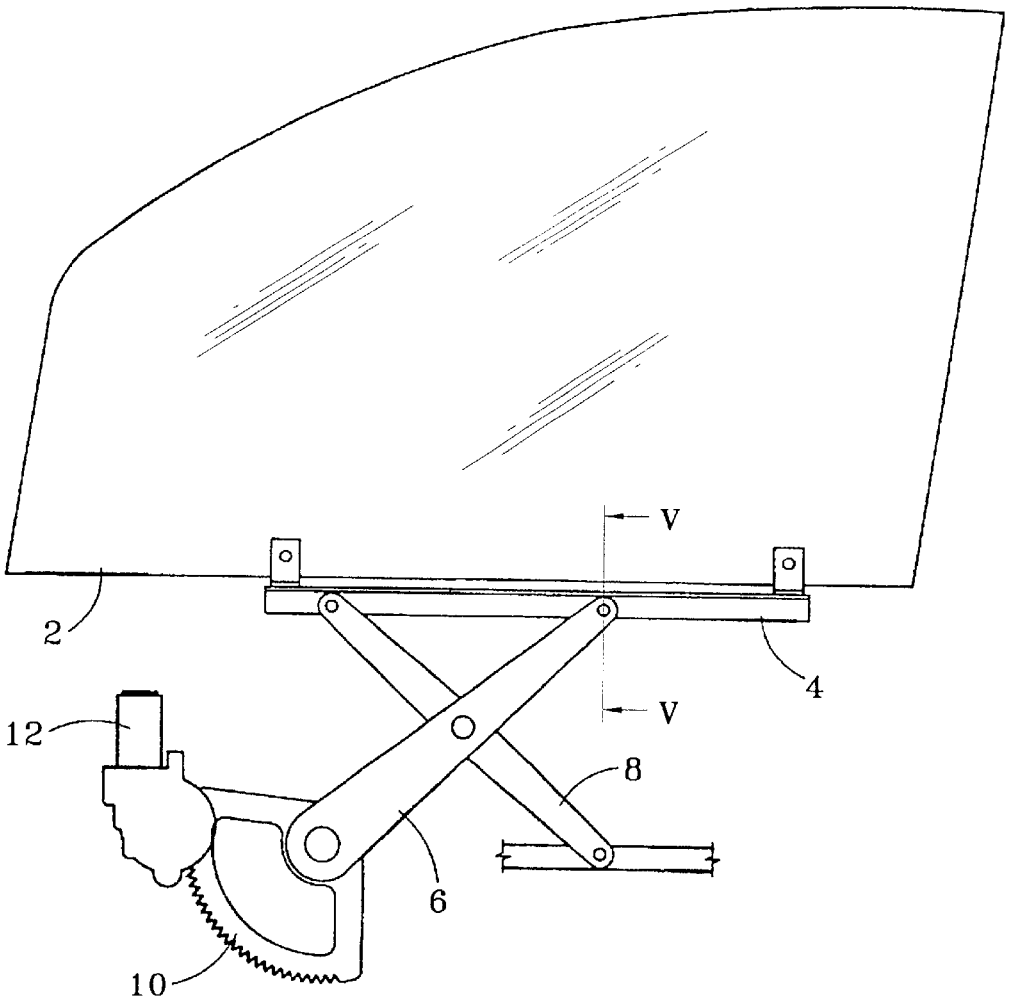
FIG. 4 is a side view of a power window regulator according to the present invention.

As shown in FIG. 4, a power window regulator according to the present invention includes a guide rail 4 fixed to a lower end of a door glass 2, a main arm 6 and a sub arm 8 connected for linear motion on the guide rail 4 and mounted crosswise, a driving motor 12 connected to a sector gear 10 mounted underneath the main arm 6 to rotate the main arm 6, and flex means for providing flexibility to a connection area between the main arm 6 and the guide rail 4 when the door glass 2 vertically moves.

Figure 5:
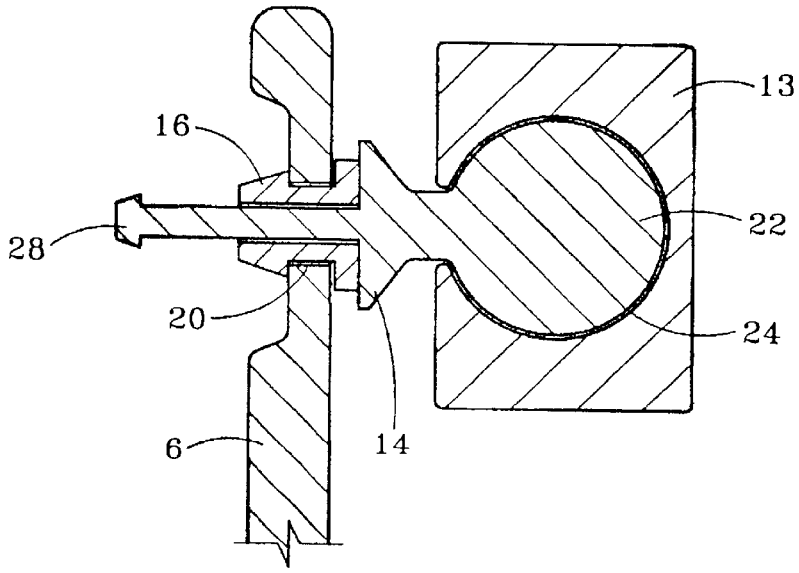
FIG. 5 is a sectional view taken along line V—V of FIG. 4.
Figure 6:
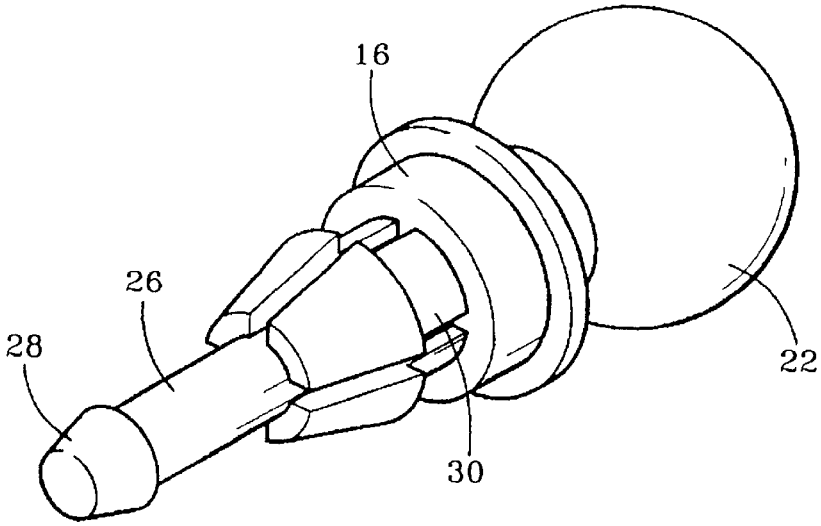
FIG. 6 is a perspective view illustrating a slide shaft structure of power window regulator according to the present invention.

Referring to FIGS. 5 and 6, the flex means comprises a slider 13 mounted on the guide rail 4 for linear movement, a slide shaft 14 rotatably mounted on the slider 13 and a grip 16 as explained below. The slide shaft 14 is formed at one side thereof with a spherical ball part 22 while the slider 13 is formed with a spherical ball groove 24 for the ball part 22 to be rotatably inserted thereinto. In the case where there is angular variation at the slide shaft 14, the ball part 22 may rotate at the ball groove 24 of the slider to permit such angular variation within a predetermined range without causing the slider 13 to bind in the guide rail 4.

Furthermore, the slider shaft 14 includes a rod-shaped part 26 having a predetermined length opposite the ball part 22. The rod-shaped part 26 is formed with a hitching jaw 28 at the end for preventing the grip 16 from being detached.

The grip 16 is centrally hollowed for the rod part 26 to be inserted thereinto and is plurally split at one side thereof for sustaining a resilience of predetermined strength. Grip 16 also has a circumferential peripheral surface with a recess 30 for being inserted into the hitching groove 20 of main arm 6. Furthermore, the grip 16 is tapered at a predetermined angle from the split side to the other side for easy insertion into the hitching groove 20.

The grip 16 linearly moves with rod-shaped part 26, and is plurally split at one side thereof to provide resilience to external direction after being inserted into the hitching groove 20 for preventing detachment from the hitching groove 20. The tip end of the grip 16 is hitched at the hitching jaw 28 of the rod-shaped part to prevent detachment from the rod-shaped part 26. As described above, grip 16, connected to the main arm 6, linearly moves on the rod-shaped part 26 to provide flexibility between the main arm 6 and the guide rail 4 when the door glass 2 vertically moves.

Now, operations of the vehicular power window regulator thus constructed according to the present invention will be described.

When a door glass switch is turned on, the driving motor 12 is driven in the forward or reverse direction according to the applied power, and the sector gear 10, meshed with the driving motor 12, is rotated according to rotation of the driving motor 12 to rotate the main arm 6. Successively, the other side of the main arm 6 is linearly moved along the guide rail 4 to vertically move the door glass 2.

The door glass 2 is shaped with a predetermined curvature to move on a curvilinear route, while the main arm 6 moves along a linear route, such that a flexibility is required at the connection between the guide rail 4 and the main arm 6 according to the difference in motion therebetween. Thus, the ball part 22 at the slider shaft, being rotatably inserted into the ball groove 24 of the slider, provides flexibility for the slide shaft 14. Flexibility is provided both relative to angular change with respect to a line vertically connecting the curvilinear route of the door glass 2 and linear route of the main arm 6, while the grip 16 linearly moves on the slider shaft 14 to provide lengthwise flexibility of slide shaft 14, and with respect to a length change of a line vertically connecting the curvilinear route of the door glass 2 and linear route of the main arm 6.

As apparent from the foregoing, there is an advantage in the vehicular power window regulator thus described according to the present invention in that flexibility required when a door glass vertically moves is appropriately provided to a connection area of the guide rail where the main arm and door glass are connected to thereby prevent working forces such as compression and tension from being generated, and to avoid the main arm from being bent when the door glass moves along a curved route. The present invention thus helps prevent the sector gear from being applied with an excessive force to decrease noise caused by gear meshing. There is another advantage in that minimal reinforcement is needed to cope with the compression and tension generated when the door glass is vertically moved to thereby enable to greatly reduce parts in weights and sizes thereof for decrease of manufacturing cost and overall weight of vehicular.

What is claimed is:

1. A vehicular power window regulator, the regulator comprising:

a guide rail fixed to a lower end of a door glass;

a main arm and a sub arm connected for linear motion on the guide rail and mounted crosswise;

a driving motor connected to a sector gear mounted underneath the main arm to rotate the main arm; and flex means for providing flexibility to a connection area between the main arm and the guide rail when the door glass vertically moves, wherein said flex means comprises:

a slider mounted on the guide rail for linear movement;

a slide shaft rotatably mounted on the slider; and a grip, having an inner circumferential surface thereof and placed over the slide shaft opposite the slider and an external circumferential surface thereof inserted into the main arm, for connecting an area between the slide shaft and the main arm.

2. The regulator as defined in claim 1, wherein the slide shaft is formed at one side thereof with a spherical ball part while the slider is formed with a spherical ball groove for the ball part to be rotatably inserted thereinto.

3. The regulator as defined in claim 1, wherein the grip is centrally hollowed for the rod part to be inserted thereinto and is plurally split at one side thereof for sustaining a resilience of predetermined strength, and is provided at a circumferential peripheral surface thereof with a recess for being inserted into the hitching groove of the main arm.

4. The regulator as defined in claim 3, wherein the grip is tapered at a predetermined angle from the split side to the other side for easy insertion into the hitching groove.

5. The regulator as defined in claim 3, wherein the slider shaft is formed at a tip end thereof with a hitching jaw to prevent the grip from being detached therefrom.

* * * * *